US005551361A

United States Patent [19]

Clapp et al.

[11] Patent Number: 5,551,361

[45] Date of Patent: Sep. 3, 1996

[54] SEWING MACHINE HAVING PRESSER BAR SYSTEM FOR MAINTAINING CONSTANT CONTACT FORCE BETWEEN PRESSER FOOT AND FABRIC

[75] Inventors: Timothy G. Clapp, Raleigh, N.C.; George R. Barrett, Ann Arbor, Mich.

[73] Assignee: North Carolina State University, Raleigh, N.C.

[21] Appl. No.: 423,639

[22] Filed: Apr. 17, 1995

[51] Int. Cl.[6] ..... D05B 29/02

[52] U.S. Cl. ..... 112/475.01; 112/235; 112/470.01

[58] Field of Search ..... 112/235, 239, 112/470.01, 270, 475.01

[56] References Cited

U.S. PATENT DOCUMENTS 4,726,309 2/1988 Popp ..... 112/235 X 4,873,931 10/1989 Takagi et al. ..... 112/470.01

FOREIGN PATENT DOCUMENTS 1064279 4/1986 Japan ..... 112/235

4348793 12/1992 Japan ..... 112/235

*Primary Examiner*—Peter Nerbun

*Attorney, Agent, or Firm*—Richard E. Jenkins, P.A.

[57] ABSTRACT

A sewing machine having a presser bar with a force transducer mounted thereon for detecting forces applied to the presser bar during high speed sewing and an electromagnetic actuator operatively connected to the presser bar. Circuit means is electrically connected to the force transducer and to the electromagnetic actuator and is adapted to control current to the electromagnetic actuator so as to maintain a constant contact force between the presser foot and a fabric being sewn.

20 Claims, 6 Drawing Sheets

SEWING MACHINE HAVING PRESSER BAR SYSTEM FOR MAINTAINING CONSTANT CONTACT FORCE BETWEEN PRESSER FOOT AND FABRIC

GOVERNMENT INTEREST

This invention was made with Government support under Grant No. 533709-83404 awarded by the Department of Commerce. The Government has certain rights in this invention.

TECHNICAL FIELD

As is known by those skilled in the art, a great deal of research has been undertaken over the last several decades to obtain a better understanding of the complex interactions involved in joining two or more plies of material with thread during high speed sewing. Although nearly two centuries have passed since the invention of the basic sewing machine, rigorous scientific analysis of the operation of the sewing machine did not begin until sewing machine speeds recently increased beyond about 3,000 stitches per minute. At this sewing speed, the number of problems related to sewability increases significantly due to the higher machine speeds and the newer types of textile materials being stitched together.

Apparel assembly is a key segment in the textile industry, and the sewing machine is at the heart of the apparel assembly process. The aforementioned high speed sewing machine development has served to increase both the speed and quality of the sewing process in apparel assembly, but the high speed sewing has also created a problem with respect to adverse presser foot dynamics which can affect seam quality.

The standard lockstitch sewing machine uses a fabric feeding system which utilizes the motion of a feed dog to sandwich the fabric being sewn between itself and the presser foot. The force applied to the fabric by the presser foot is usually determined by an operator who adjusts the compression of the presser spring. However, experience has shown that an incorrect force applied to the fabric during fabric feeding may produce certain well known sewing defects.

Due to the interaction of the feed dog positioned beneath and extending through the needle plate so as to act in cooperation with the presser foot, the force applied to the fabric during fabric feeding is normally not constant. In fact, at the very high sewing speeds of modern sewing machines in the apparel industry, the presser foot of the sewing machine will actually tend to leap or bounce from the fabric. The bouncing of the presser foot creates a lack of control over the fabric that can reduce seam quality, and by pulling the sewing thread taunt before a suitable lockstitch is formed the bouncing presser foot can result in skipped stitches during the sewing process. Although the operator can adjust the force applied to the fabric by the presser foot by adjusting the compression of the presser spring, the manual adjustment has proven to be unsatisfactory at solving the bouncing presser foot problem since variations in force exerted are inevitable in conventional high speed sewing machines. Applicants have now met a long-felt need for a solution to this problem with the apparatus and method of the present invention for maintaining constant force between the presser foot and fabric being sewn.

DISCLOSURE OF THE INVENTION

In accordance with the present invention, applicants provide a sewing machine having a system for applying constant force between the presser foot and a fabric being sewn which is independent of fabric guide forces. The system accomplishes this objective by detecting the load being applied to the presser bar, and converting the detected load measurements into corresponding signal data. The signal data is then used to control the current to an electromagnetic actuator means operatively connected to the presser bar of the sewing machine in response to the signal data so as to maintain a constant force between the presser foot and a fabric being sewn during the sewing process. In this fashion, a constant contact force is maintained between the presser foot of the sewing machine and a fabric being sewn independent of the fabric guiding forces in order to optimize material stitch quality of the sewing machine.

The sewing machine and presser bar system of the invention for maintaining a constant force between the presser foot and a fabric being sewn includes a force measurement means mounted on the presser bar for measuring forces applied to the presser bar during sewing. Electromagnetic actuator means is provided which is operatively connected to the presser bar, and circuit means is provided which is electrically connected to the force measurement means and the electromagnetic actuator means and adapted to control the current to the electromagnetic actuator means so as to maintain a constant contact force between the presser foot and fabric being sewn during the sewing process. In this fashion, the sewing machine and presser bar system of the present invention serves to maintain constant contact force between the presser foot and the fabric being sewn during high speed sewing which is independent of fabric guide forces created by the feed dog's position beneath and extending through the needle plate in order to guidably urge the fabric being sewn along a direct path of travel.

Accordingly, it is an object of the present invention to provide a sewing machine having a system for maintaining constant contact force between the presser foot and a fabric being sewn independent of fabric guide forces in order to facilitate high speed sewing without adverse presser foot dynamics.

Another object of the present invention is to provide a sewing machine having a system for maintaining constant contact force between the presser foot of a sewing machine and a fabric being sewn which prevents reduced seam quality caused by the presser foot bouncing or leaving the fabric during a high speed sewing process.

A further object of the present invention is to provide a sewing machine having a system for maintaining a constant contact force between the presser foot and a fabric being sewn so as to alleviate common stitch problems associated with uncontrolled sewing caused by adverse presser foot dynamics during a high speed sewing process.

It is still another object of the present invention to provide a sewing machine having a system for maintaining a constant contact force between the presser bar of a high speed sewing machine and a fabric being sewn so as to improve the quality of apparel assembly.

Some of the objects of the invention having been stated hereinabove, other objects will become evident as the description proceeds, when taken in connection with the accompanying drawings described hereinbelow.

BEST MODE FOR CARRYING OUT THE INVENTION

"Floating" and "bouncing" of the presser foot of a sewing machine are conditions that are generally associated with high speed operation of sewing machines in the apparel industry. "Floating" describes the condition when the feed dog beneath the sewing station strikes the presser foot with such force as to cause the foot to separate from the fabric during the sewing process. "Bouncing" describes the motion of the presser foot when the feed dog travels downward after feeding the fabric and leaves the presser foot to descend under the influence of the force spring. The amount of energy stored in the dynamics of the presser foot causes the foot to rebound repeatedly off the throat plate thereby leaving the fabric. Both conditions are well known to result in a loss of fabric control and a degradation in sewing stitch quality.

In order to solve the floating and bouncing phenomenon, applicants have developed a control system which acts to maintain a constant contact force between the presser foot and a fabric being sewn which is independent of fabric guide forces from the feed dog. Previous attempts at control of the presser foot have been non-active approaches such as increasing presser force or the addition of springs to the contact area of the presser foot. These methods were arrived at by trial and error and can only eliminate unwanted dynamics of the presser foot for fabrics of certain characteristics. Practicality for modern apparel manufacturing requires that the control system for a high speed sewing machine be more flexible than non-active techniques. Applicants' invention provides a flexible presser foot control system to eliminate unwanted presser foot dynamics and to provide a means to actively alter the force exerted by the presser foot onto the fabric and to place the presser foot at any desired location during the stitch cycle.

Figure 1A:
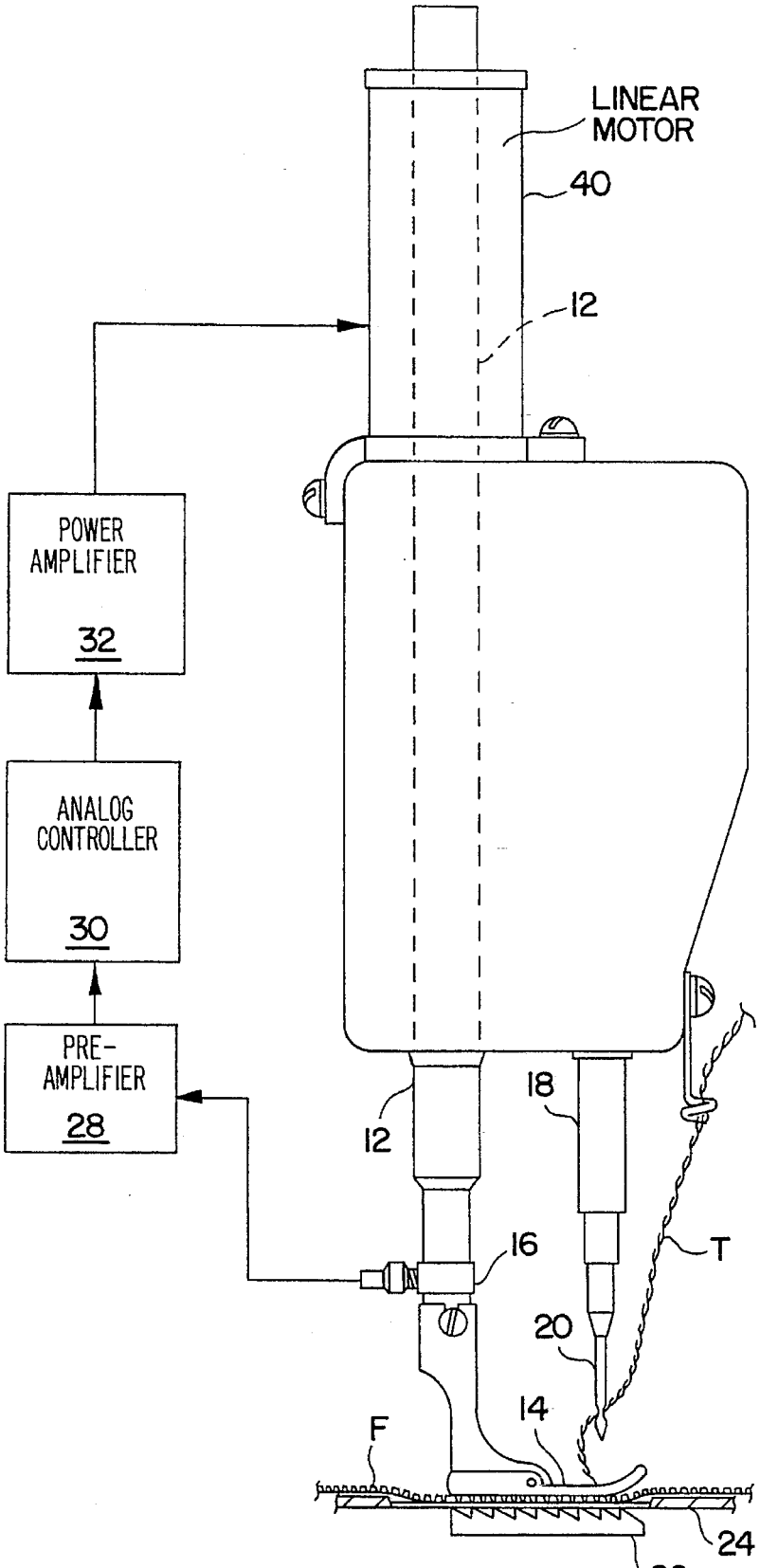
FIG. 1A is a side elevation view of the fabric feeding and stitch formation elements of the sewing machine and associated presser bar system of the invention for maintaining constant contact force between the presser foot and fabric.

With reference now to the drawings, a preferred embodiment of the sewing machine having a constant contact force application system according to the present invention is best seen with reference to FIG. 1A. The invention comprises a sewing machine with a presser bar 12 carrying a presser foot 14 at the bottom end thereof. A force transducer 16, most suitably a piezoelectric quartz load washer, is mounted on presser bar 12 for detecting forces applied to presser bar 12 during high speed sewing. Needle bar 18 carries needle 20 at the lower end thereof. Thread T and needle 20 and conventional throttle plate 24 and feed dog 26 are also illustrated in FIG. 1. Although other sewing machines are clearly contemplated by the invention, the preferred embodiment of the present invention utilizes a PFAFF Model 483 lockstitch sewing machine.

Force transducer 16 is most suitably a KISTLER type 9001 quartz load washer (or piezoelectric force transducer) which is mounted directly onto the shaft of presser bar 12 (preferably into a cut and machine leveled presser shaft to ensure uniform force distribution throughout the supporting surface). Force transducer 16 is electrically connected to signal pre-amplifier 28, most suitably a ENDEVCO brand Model No. 4416B, and the pre-amplified signal from pre-amplifier 28 is output to analog controller 30, most suitably a PARKER HANNIFIN (DAEDAL DIVISION) brand Model No. MC7000. Pre-amplifier 28 serves to condition the force signals received from force transducer 16, and the conditioned signal is then output to an analog controller 30. Analog controller 30 utilizes both active and passive circuitry to generate a control signal based on the force signal from transducer 16 which is then amplified by power amplifier 32, most suitably a NATIONAL SEMICONDUCTOR brand Model No. LM12CLK, to provide enough current to power linear motor 40 which is operatively connected to presser bar 12 and presser foot 14 at the lowermost end thereof. Linear motor 40 is most suitably a NORMAG non-commutated D.C. motor Model No. ML21511023LB available from Normag, Inc. of Santa Clarita, Calif.

Figure 1B:
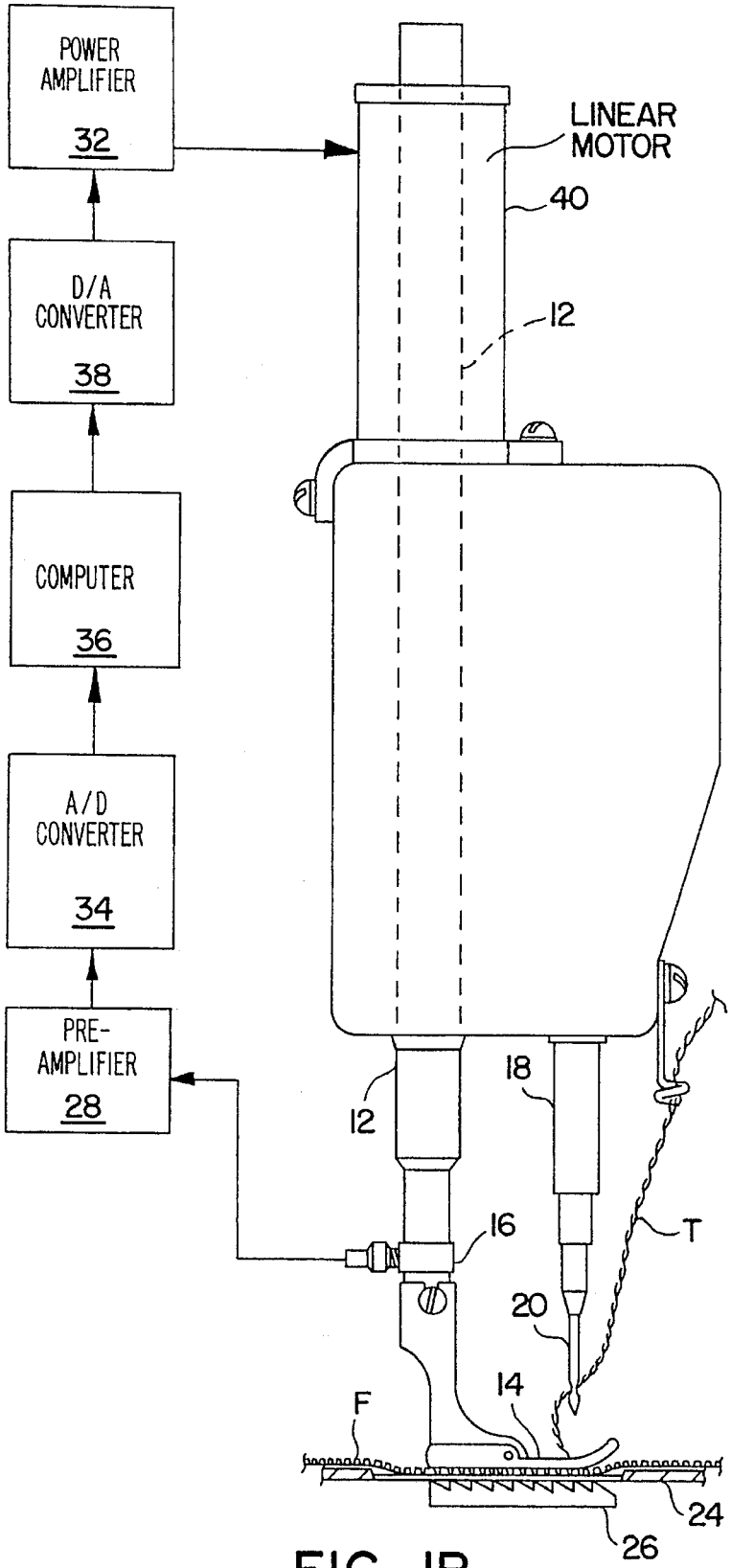
FIG. 1B is a side elevation view of an alternative embodiment of the invention.

An alternative embodiment is shown in FIG. 1B of the drawings to provide more advanced control schemes for maintaining a constant contact force between presser foot 14 and a fabric F being sewn. The presser bar control system shown in FIG. 1B essentially replaces analog controller 30 of FIG. 1A with microprocessor or computer 36 and associated input signal A/D converter 34 and output signal D/A converter 38. Thus, force signals from force transducer 16 are now received by pre-amplifier 28 which conditions the force signals which are then output to A/D converter 34, computer 36 and D/A converter 38. The signal from D/A converter 38 is then output to previously described power amplifier 32 and linear motor 40. Thus, the computer 36 is utilized to perform numerical computations resulting in a control signal that must be converted from a digital signal to an analog signal by D/A converter 38 and then amplified by power amplifier 32 prior to being input to linear motor 40.

Although other equipment may be utilized, A/D converter 34 is most suitably a COMPUTER BOARDS, INC. brand Model No. CIO-DAS 16/330 and D/A converter 38 is most suitably a COMPUTER BOARDS, INC. brand Model No. CIO-DDA-06/12. Computer 36 is most suitably a personal computer preferably utilizing an INTEL 80486 microprocessor and programmed in a manner which would be known to one skilled in the art so as to sample force signal data from force transducer 16 and output a signal to D/A converter 38 to control linear motor 40 in such a manner as to maintain a constant contact force between presser foot 14 and fabric F during the sewing process. In this fashion, linear motor 40 is caused to produce forces on presser bar 12 and presser foot 14 at the lowermost end thereof at all times during the sewing process in accordance with signals from computer 36.

Computer 36 may be equipped with interface circuitry so that computer 36 can communicate with other devices in the workspace. In this fashion, other devices (such as photo-optical detectors) may be used to inform computer 36 of the type of fabric being sewn or how many plies of fabric are being sewn, etc. and this information can in turn be used by computer 36 to adjust the constant force being applied between presser foot 14 and fabric F according to the program within computer 12 to assure proper feeding of fabric F and proper stitch formation of Fabric F during the high speed sewing process. In this manner a sewing machine can be caused to adapt to changing sewing conditions during a high speed sewing process.

As noted hereinbefore, applicants contemplate that computer 36 may be suitably programmed in a manner which would be known to one skilled in the art in order to accommodate certain desired performance parameters and/or to communicate with other devices in the workspace in order to adjust the steady-state constant force being maintained between presser foot 14 and fabric F.

To more fully explain applicants' invention, a detailed mathematical model will be described hereinbelow wherein presser bar force data is gathered and analyzed according to a predetermined program which acts to generate a linearized signal to a more rudimentary embodiment of applicants' linear motor 40 comprising a control electromagnet mounted on a sewing machine and utilized to induce a current within a closed coil secured to presser bar 12. The objective of the mathematical model is to maintain a constant contact force between the presser foot of a sewing machine and a fabric being sewn so as to overcome detrimental sewing dynamics such as "bouncing" and thereby improve the quality of apparel assembly by maintaining control of the presser foot during stitch formation.

MATHEMATICAL MODEL

Figure 2:
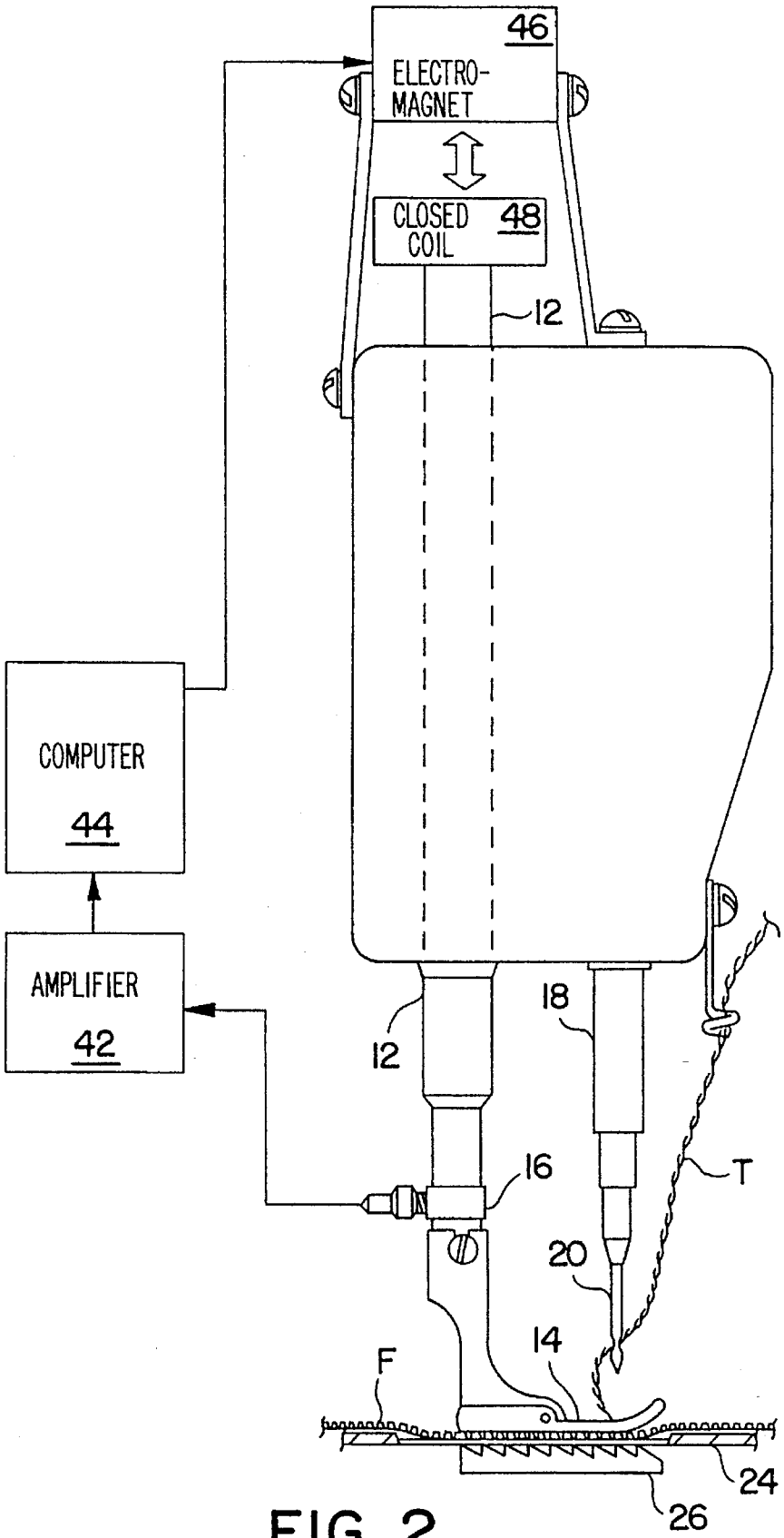
FIG. 2 is a side elevation view of a third embodiment of the invention utilized in the mathematical modeling thereof set forth herein.

A modified laboratory embodiment of the invention is used to develop the mathematical model set forth below and it is shown in FIG. 2. Amplifier 42 enhances the force signals from force transducer 16 which are then input to microprocessor or computer 44. A position sensor (not shown), as an option, may be operatively connected to the presser bar of the FIG. 1–2 embodiments of the invention. A SCHAEVITZ brand Model No. 250 MHR position sensor was utilized in the FIG. 2 embodiment of the invention to help develop the mathematical model by providing vertical displacement signal data regarding presser bar 12 to computer 44. Computer 44 processes the force and position signals and outputs current to electromagnet 46 which induces a current in closed coil 48 to maintain a desired force between presser foot 14 and fabric F.

Figure 3:
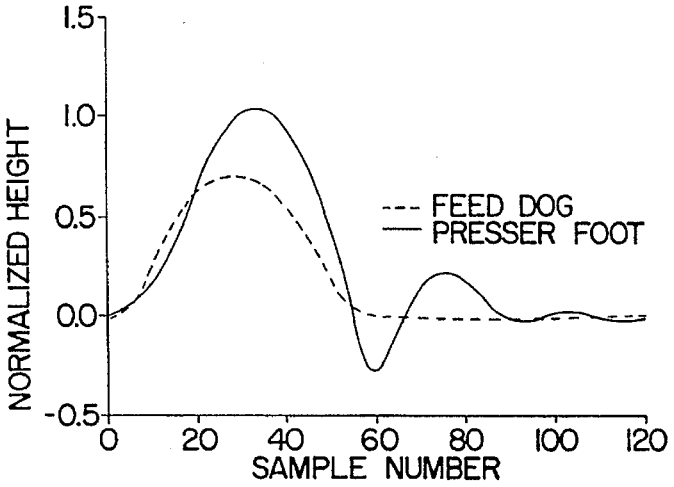
FIG. 3 depicts uncompensated FIG. 2 presser foot displacement during fabric feeding and the resulting bouncing phenomenon.

As is well known, the presser spring (not shown) within the sewing machine exerts a force onto presser bar 12. Presser bar 12 then provides the force to presser foot 14. During the sewing process, feed dog 26 travels upward from beneath throat plate 24 and pinches fabric F being sewn between itself and presser foot 12. Feed dog 26 then moves toward the rear of the sewing machine causing fabric F to move with it. Of interest, applicants in FIG. 3 show uncompensated presser foot displacement during fabric feeding. The characteristic bouncing can be readily appreciated with reference to FIG. 3 as well as the fact that during times of displacement greater than feed dog 26, fabric control is lost. During times of negative displacement relative to feed dog 26 a fabric F is crushed.

Various passive devices have previously evolved to compensate for adverse presser foot dynamics, but these "floating feed" type devices are typically based on the concept of reducing the mass of the presser foot assembly to increase the resonant frequency of the system significantly above the harmonics of the feeding forces. Furthermore, the damping performance of these prior art devices relies on the properties of a fabric being sewn. Thus, if the sewing machine speed is significantly increased, the passive type devices will not reliably provide stable feeding of fabric.

To maintain control of fabric F being sewn during high speed sewing, applicants utilize the active control scheme described herein to control electromagnet 46 which induces and interacts with currents in closed coil 48 mounted to a rigid extension of presser bar 12. In turn, closed presser coil 48 will produce forces on presser bar 12 which, when linearized as described herein, will assure stable control of presser foot 14 and fabric F at all times during a high speed sewing process.

Many attempts have been made to model the interaction of the feed dog with the presser foot. All of these attempts have been focused on understanding the effects of high speed on the sewing system. Applicants use the force method, i.e., differential equations, to model the feed dog/presser foot interaction since it is most applicable to control theory.

One difficulty in producing a useful sewing machine model is the fact that presser foot 14 and feed dog 26 are not physically connected. When the two are in contact, the sewing machine has a simple model. When presser foot 14 and feed dog 26 are not in contact, such as when the presser foot is bouncing, the sewing machine has a different model. The difference between these two models is magnified when the presser spring (not shown) is removed from the model leaving the presser bar detached from the rest of the sewing machine. For each condition of "contact" and "no contact" the models can be linear, but if both conditions can occur then the combined model is very non-linear (by "very" applicants mean that the presser foot/feed dog contact condition produces drastic alterations in the dynamics of the presser foot.)

Figure 4:
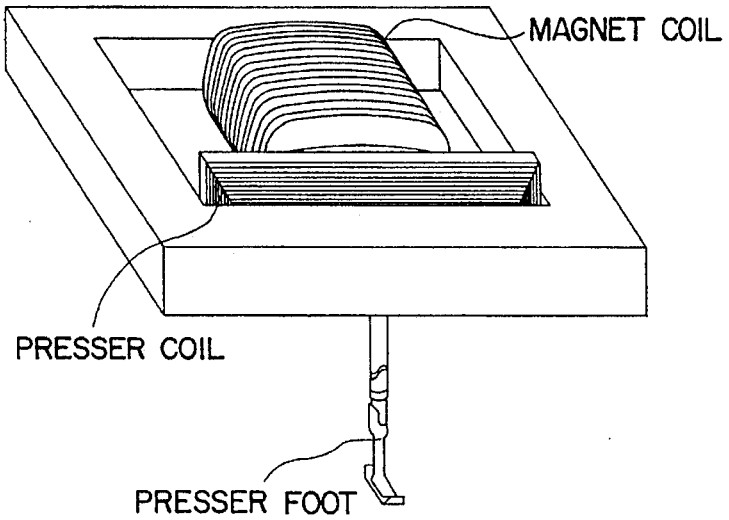
FIG. 4 is a simplified representation of the control device utilized in the presser bar system of FIG. 2 for maintaining constant contact force between the presser foot and fabric.

To mathematically model the presser assembly dynamics with the control magnet included, there are three subsystems that must be considered:

1. Presser Bar and Foot
2. Presser Coil, and
3. Control magnet and input (see FIG. 4).

Applicants will now consider each subsystem individually.

PRESSER ASSEMBLY

Figure 5:
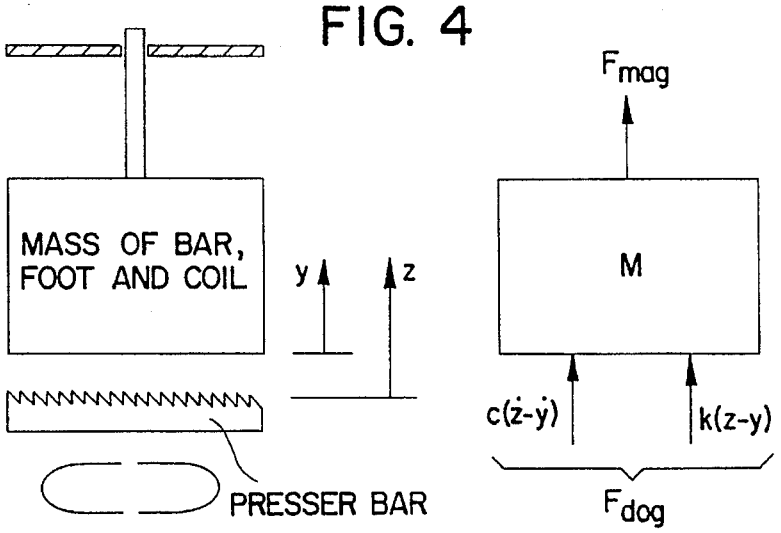
FIG. 5 depicts an idealized model of the subsystem of FIG. 2 consisting of the presser bar and presser foot.

Applicants begin by modeling the subsystem consisting of presser bar 12 and presser foot 14. FIG. 5 represents the idealized model used. The differential equation used to model this system is $$M\ddot{y}=F_{dog}+F_{mag}-Mg \quad (1)$$

where M is the combined mass of the presser foot, presser coil, and presser bar, $F_{dog}$ is the force due to the motion of the feed dog, and $F_{dog}$ is due to the applied magnetic forces. $F_{dog}$ is composed of two forces that include the metal flexing and losses occurring during the feed dog and presser foot interaction. The spring constant, k, represents the elastic component of the feed dog and presser foot interaction, and the constant, c, represents losses occurring during the interaction. Both k and c can be determined experimentally.

Applicants will define the height, y to be the state $x_1$, and the velocity, $\dot{y}$, to be the state $x_2$. Both the velocity and effective displacement of the feed dog will be considered external inputs or disturbances. Thus, when presser foot 14 and feed dog 26 are in contact the state equations for this subsystem are $$\dot{x}_1 = x_2 \tag{2}$$

$$\dot{x}_2 = -\frac{k}{M}x_1 - \frac{c}{M}x_2 + \frac{1}{M}F_{mag} + \frac{c}{M}\dot{z} + \frac{k}{M}z - g. \tag{3}$$

If presser foot 14 and feed dog 26 are not in contact (and the presser spring is removed) the presser assembly is a floating mass and is only affected by the presser coil. Hence, the state equations for the no contact condition are $$\dot{x}_1 = x_2 \tag{4}$$

$$\dot{x}_2 = \frac{1}{M}F_{mag} - g. \tag{5}$$

PRESSER COIL

Figure 6:
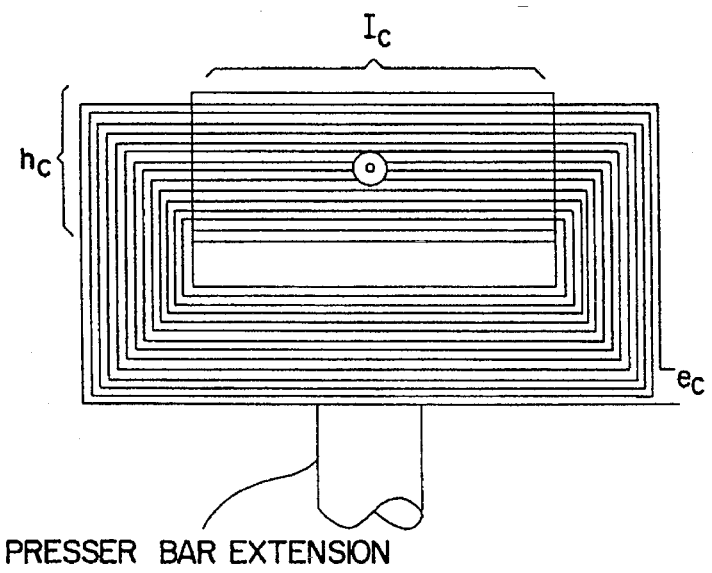
FIG. 6 is a schematic representation of the presser bar coil of FIG. 2.

The forces generated by coil 48 are due to an induced current within the coil, and a current due to a directly applied control voltage. Currents within presser coil 48 produce a magnetic field which interacts with the field of control magnet 46. The interaction of the magnetic fields produces forces which will be used to control the dynamics of the presser assembly. Coil 48 is shown in FIG. 6. The measures $h_c$ and $l_c$ refer to the height and length of the coil exposed to the magnetic field of control magnet 46. The remainder of the coil is used as a return path for the induced current. Because the area enclosed by each loop is different, applicants will assume a nominal enclosed area, $A_c$, of $$A_c = \frac{h_c l_c}{2}. \tag{6}$$

Figure 7:
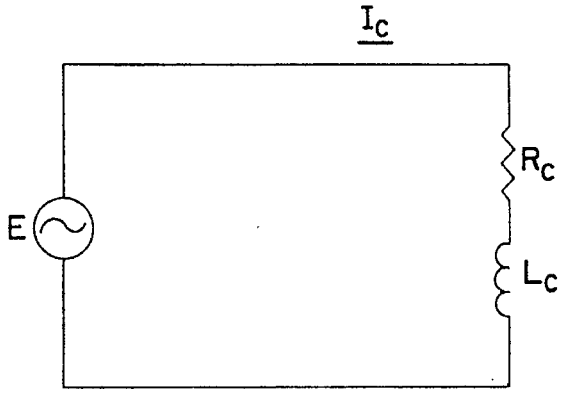
FIG. 7 illustrates an equivalent electric circuit of the presser bar coil of FIG. 2.

The equivalent circuit for presser coil 48 is considered as a source with a lumped resistance and inductance as shown in FIG. 7. From FIG. 7, the differential equation governing the current flowing in the presser coil is $$E = i_c R_c + L_c \frac{di_c}{dt}, \tag{7}$$

and also $$\frac{di_c}{dt} = -i_c \frac{R_c}{L_c} + \frac{1}{L_c}E \tag{8}$$

The current in FIG. 7 is the effect of the applied voltage, $e_c$, and induces voltages. If applicants assume the field is perpendicular to the coil and that the field is uniform, the general case of Faraday's law simplifies to $$E = e_c - N_c B_\phi l_c v + N_c A_c \frac{dB_\phi}{dt}. \tag{9}$$

where $N_c$ is the number of presser coil loops, $B_\phi$ is the uniform flux density, and $A_c$ is the enclosed area of the coils.

Applicants will define the state $x_4$ to be the current flow in presser coil 48. The state equation is found to be $$\dot{x}_4 = -\frac{N_c B_\phi l_c}{L_c}x_2 + \frac{N_c A_c}{L_c}\frac{dB_\phi}{dt} - \frac{R_c}{L_c}x_4 + \frac{1}{L_c}e_c \tag{10}$$

where $L_c$ is the inductance of the presser coil. The force acting on coil 48 in the +y direction due to the induced current is then $$F_{mag} = N_c(X_4 l_c \times b_{526}). \tag{11}$$

CONTROL MAGNET

Figure 8:
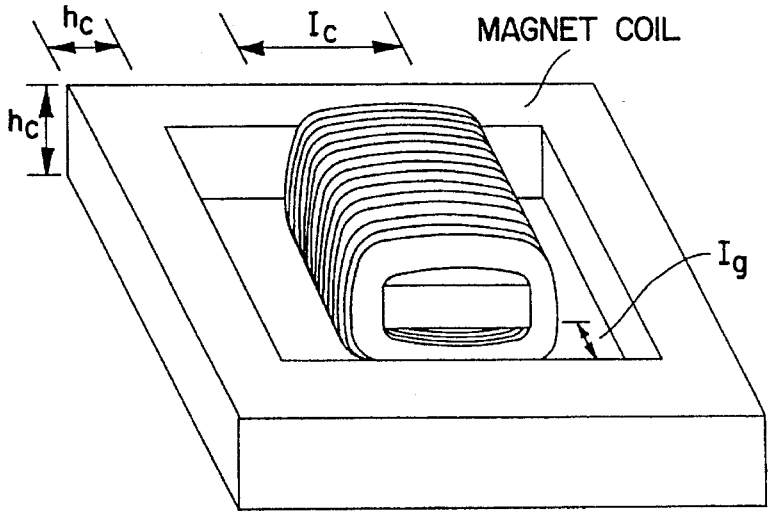
FIG. 8 is a schematic view of the electromagnet of FIG. 2.

Applicants begin the modeling of control magnet 46 by assuming a design of the magnet. The magnet is comprised of $N_m$ coils with a lumped resistance of $R_m$ Ohms and inductance $L_m$ Henrys. The magnet has the dimensions $h_c$, $l_c$, and $l_g$ as shown in FIG. 8. When a coil of wire is would around the magnet core, and current is allowed to flow through the coil, the magnetic flux density in the air gap is approximated by $$B_\phi = \frac{\mu_o N_m I_m}{l_g} \tag{12}$$

where $\mu_o = 4\pi \times 10^{-7}$, $l_g$ is the length of the air gap, and $I_m$ is the current through the wire. For simplicity, applicants will assume that the mutual inductance of presser coil 48 and the magnet coil is neglible.

The equivalent circuit of the magnet coil will be similar to that in FIG. 7. The differential equation for this equivalent circuit is $$e_m = I_m R_m + L_m \frac{dI_m}{dt}. \tag{13}$$

The state variable $x_3$ will be defined as the current, $I_m$, and the state equation of the magnet circuit is found to be $$\dot{x}_3 = -\frac{R_m}{L_m}x_3 + \frac{1}{L_m}e_m. \tag{14}$$

The flux can be written in terms of the state $x_3$ as $$B_\phi = \frac{\mu_0 N_m}{l_g}x_3. \tag{15}$$

THE STATE EQUATIONS

Now the non-linear state equations can be written for the presser foot/feed dog in contact condition using Equations 2,3,10,14, and 15 as $$\dot{\underline{x}}=\begin{bmatrix} x_2 \\ -\frac{k}{M}x_1-\frac{c}{M}x_2+\frac{N_c\mu_o N_m l_c}{Ml_g}x_3x_4+\frac{c}{M}\dot{z}+\frac{k}{M}z-g \\ -\frac{R_m}{L_m}x_3+\frac{1}{L_m}e_c \\ \frac{N_cN_m\mu_o}{l_gL_c}\left(-l_cx_2x_3-\frac{h_cl_cR_m}{L_m}x_3+\frac{h_cl_c}{L_m}e_m\right)-\frac{R_c}{L_c}x_4+\frac{1}{L_c}e_c \end{bmatrix}. \quad (16)$$

For the no contact condition, the non-linear state equations are:

$$\dot{\underline{x}}=\begin{bmatrix} x_2 \\ \frac{N_c\mu_o N_m l_c}{Ml_g}x_3x_4-g \\ -\frac{R_m}{L_m}x_3+\frac{1}{L_m}e_c \\ \frac{N_cN_m\mu_o}{l_gL_c}\left(-l_cx_2x_3-\frac{h_cl_cR_m}{L_m}x_3+\frac{h_cl_c}{L_m}e_m\right)-\frac{R_c}{L_c}x_4+\frac{1}{L_c}e_c \end{bmatrix}. \quad (17)$$

The output, θ, of the system will be the compressive force on presser foot 14 as measured by a force transducer ($\theta_1$) and the displacement of the presser foot as measured by an RF proximity sensor ($\theta_2$). For the contact condition, the compressive force is $$\theta_1=M\ddot{y}-F_{mag}. \quad (18)$$

Substituting 11 and 15 for $F_{mag}$ applicants have $$\theta_1=M\dot{x}_2-\frac{N_cN_ll_{c\mu o}}{l_g}x_3x_4-Mg. \quad (19)$$

For the no contact condition there is no compression, hence $$\theta_1=0. \quad (20)$$

In 18,19 and 20 applicants assume that most of the mass M, is due to the presser bar, and so the acceleration of the mass of the presser foot itself has negligible effect.

LINEARIZATION OF THE STATE EQUATIONS

Equations 16 and 19 indicate the two controlled input system is nonlinear. To utilize linear controller design, applicants now wish to linearize the state equations, i.e., applicants want to express the state equations in the form $$\dot{x}=Ax+Bu \quad (21)$$

$$\theta=Cx+Du \quad (22)$$

where the matrices A,B,C and D are constant.

To linearize the system it is chosen that only one current be controlled. The voltage supplying presser coil 48 will be controlled, and $I_m$ will be held constant. Further, applicants will linearize the acceleration, $\dot{x}_2$, about g. Discarding the effect of gravity will have little affect in the contact condition but will have an obvious effect on the no contact condition (i.e., if no control effort is used, there will be nothing to bring presser foot 14 down.)

For the derived model, the linear state equations for the contact condition are:

$$\dot{\underline{x}}=\begin{bmatrix} 0 & 1 & 0 \\ -\frac{k}{M} & -\frac{c}{M} & \frac{N_cB_\phi l_c}{M} \\ 0 & -\frac{N_cB_\phi l_c}{L_c} & -\frac{R_c}{L_c} \end{bmatrix}\underline{x}+\begin{bmatrix} 0 & 0 & 0 \\ 0 & \frac{c}{M} & \frac{k}{M} \\ \frac{1}{L_c} & 0 & 0 \end{bmatrix}\begin{bmatrix} e_c \\ \dot{z} \\ z \end{bmatrix} \quad (23)$$

$$\Theta=\begin{bmatrix} -k & -c & 0 \\ 1 & 0 & 0 \end{bmatrix}\underline{x}+\begin{bmatrix} c \\ 0 \end{bmatrix}\dot{z}+\begin{bmatrix} k \\ 0 \end{bmatrix}z. \quad (24)$$

For the no contact condition:

$$\dot{\underline{x}}=\begin{bmatrix} 0 & 1 & 0 \\ 0 & 0 & \frac{N_cB_\phi l_c}{M} \\ 0 & -\frac{N_cB_\phi l_c}{L_c} & -\frac{R_c}{L_c} \end{bmatrix}\underline{x}+\begin{bmatrix} 0 \\ 0 \\ \frac{1}{L_c} \end{bmatrix}e_c \quad (25)$$

$$\Theta=\begin{bmatrix} 0 & 0 & 0 \\ 1 & 0 & 0 \end{bmatrix}\underline{x}. \quad (26)$$

This model is completely determined by the physical parameters of the control magnet and presser system.

MODEL SIMULATIONS

Figure 9:
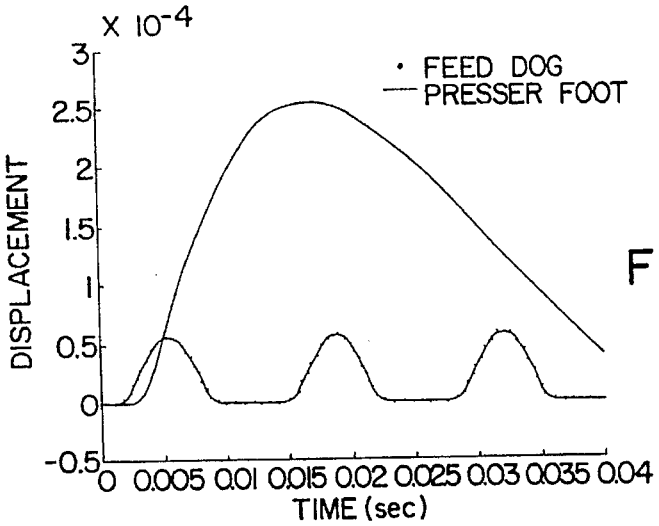
FIG. 9 depicts a simulated trajectory of the uncontrolled presser foot of FIG. 2 at a sewing machine speed of 4500 RPM.
Figure 10:
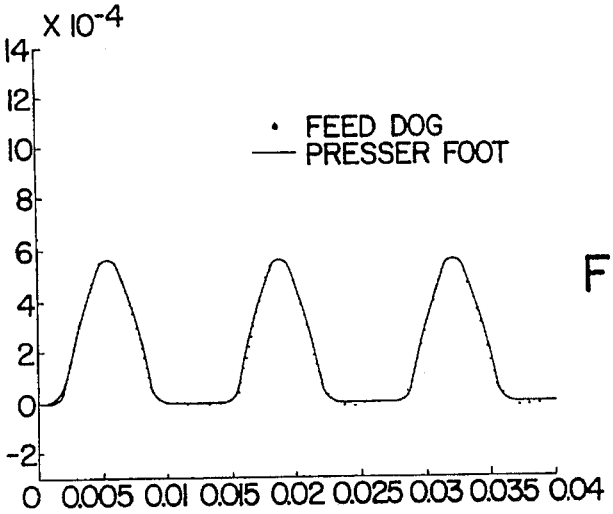
FIG. 10 depicts the FIG. 2 system response under a linear control scheme at 4500 RPM wherein the "bouncing" phenomenon has been overcome.

Now that applicants have a model for the actuator/machine system, applicants can simulate the response of the system under various sewing conditions. First, applicants show the displacement of presser foot 14 without any control at all. Due to the fact that nothing (other than gravity) will be forcing the foot down, applicants should expect that the presser foot will be "launched" by the feed dog when no control effort is expended. This effect is clearly shown in FIG. 9 where applicants simulate the trajectory of the presser foot at a machine speed of 4500 RPM. FIG. 10 shows the system response under a linear control scheme at 4500 RPM. Applicants no longer have the loss of control of the fabric or "bouncing" as was exhibited by the standard bottom feed machine with a presser spring (see FIG. 3).

Figure 11:
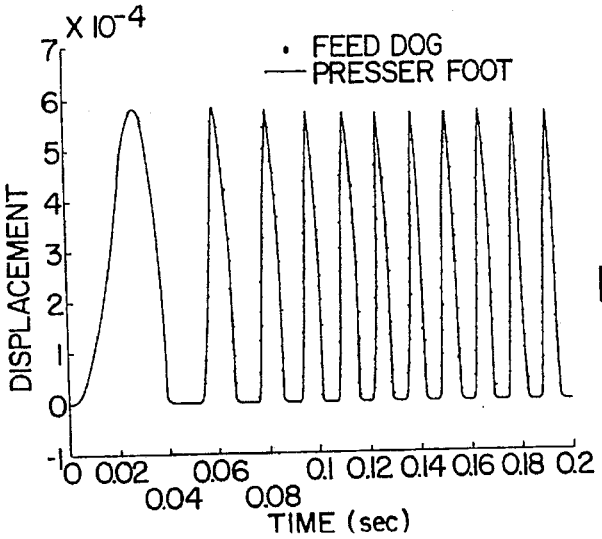
FIG. 11 depicts the trajectory of the controlled presser foot when sewing machine speed is ramped from 0 to 4500 RPM in 0.1 seconds.

FIG. 11 shows the trajectory of the controlled presser foot when the machine speed is ramped from 0 to 4500 RPM in 0.1 seconds, and the machine speed is maintained at 4500 RPM. This figure indicates that no additional dynamics are introduced due by accelerations of the sewing machine.

It will be understood that various details of the invention may be changed without departing from the scope of the invention. Furthermore, the foregoing description is for the purpose of illustration only, and not for the purpose of limitation—the invention being defined by the claims.

What is claimed is:

1. In a sewing machine having a presser bar on one end of which a presser foot is secured above a sewing station and means for guidably urging fabric along a direct path of travel below said sewing station, a system for maintaining constant force during sewing between said presser foot and said fabric independent of fabric guide forces comprising:

(a) force measurement means mounted on said presser bar for measuring forces applied to the presser bar during sewing;

(b) electromagnetic actuator means operatively connected to said presser bar for selectively imparting both compressive and lifting forces thereto; and (c) circuit means electrically connected to said force measurement means and said electromagnetic actuator means for controling the current to said electromagnetic actuator means so as to maintain a constant force between said presser foot and said fabric being sewn during sewing.

2. In a sewing machine according to claim 2 wherein said force measurement means comprises a force transducer.

3. In a sewing machine according to claim 2 wherein said force transducer is a piezoelectric load washer.

4. In a sewing machine according to claim 1 wherein said electromagnetic actuator means comprises a linear motor.

5. In a sewing machine according to claim 4 wherein said linear motor is a NORMAG non-commutated D.C. motor Model No. ML21511023LB.

6. In a sewing machine according to claim 1 wherein said circuit means comprises an analog controller to control the current to said electromagnetic actuator means as a function of signal data from said force measurement means.

7. In a sewing machine according to claim 6 wherein said analog controller is a PARKER HANNIFIN (DAEDEL DIVISION) Model No. MC7000.

8. In a sewing machine according to claim 1 wherein said circuit means comprises a computer to control the current to said electromagnetic actuator means as a function of signal data from said force measurement means.

9. In a sewing machine having a presser bar on one end of which a presser foot is secured above a sewing station and means for guidably urging fabric along a direct path of travel below said sewing station, a system for maintaining constant force during sewing between said presser foot and said fabric independent of fabric guide forces comprising:

(a) a force transducer mounted on said presser bar for measuring forces applied to the presser bar during sewing;

(b) an electromagnetic linear motor operatively connected to said presser bar for selectively imparting both compressive and lifting forces thereto; and (c) circuit means electrically connected to said force transducer and said linear motor for controlling the current to said linear motor so as to maintain a constant force between said presser foot and said fabric being sewn during sewing.

10. In a sewing machine according to claim 9 wherein said transducer is a piezoelectric load washer.

11. In a sewing machine according to claim 9 wherein said linear motor is a NORMAG non-commutated D.C. motor Model No. ML21511023LB.

12. In a sewing machine according to claim 9 wherein said circuit means comprises an analog controller to control the current to said linear motor as a function of signal data from said force transducer.

13. In a sewing machine according to claim 12 wherein said analog controller is a PARKER HANNIFIN (DAEDEL DIVISION) Model No. MC7000.

14. In a sewing machine according to claim 9 wherein said circuit means comprises a computer to control the current to said linear motor as a function of signal data from said force measurement means.

15. A method for maintaining a constant force during sewing between the presser foot of a sewing machine and a fabric being sewn by the machine independent of the fabric guiding forces in order to optimize material stitch quality, the method comprising the steps of:

(a) providing the sewing machine with force measurement means mounted on the presser bar, electromagnetic actuator means operatively connected to the presser bar, and circuit means electrically connected to the force measurement means and the electromagnetic actuator means for controlling the current to electromagnetic actuator means;

(b) detecting the load being applied to the presser bar during sewing;

(c) converting the detected load measurements into corresponding signal data during sewing; and (d) controlling the current to the electromagnetic actuator means during sewing in response to the signal data so as to maintain a constant contact force between the presser foot and fabric being sewn during sewing by selectively imparting both compressive and lifting forces to said presser bar.

16. A method according to claim 15 wherein the force measurement means comprises a force transducer.

17. A method according to claim 15 wherein the electromagnetic actuator means comprises a linear motor.

18. A method according to claim 17 wherein said linear motor is a NORMAG non-commutated D.C. motor Model No. ML21511023LB.

19. A method according to claim 15 wherein said circuit means comprises an analog controller to control the current to the electromagnetic actuator means as a function of the signal data from the force measurement means.

20. A method according to claim 15 wherein said circuit means comprises a computer to control the current to the electromagnetic actuator means as a function of signal data from the force measurement means.

* * * * *